United States Patent [19]

Chow

[11] Patent Number: 4,762,033

[45] Date of Patent: Aug. 9, 1988

[54] RATCHET WRENCH WITH MANUAL DISASSEMBLY CAPABILITY

[75] Inventor: Kirk K. Chow, Dallas, Tex.

[73] Assignee: National Hand Tool Corporation, Dallas, Tex.

[21] Appl. No.: 17,731

[22] Filed: Feb. 24, 1987

[51] Int. Cl.[4] ..... B25B 13/46

[52] U.S. Cl. ..... 81/63.2; 81/177.85

[58] Field of Search ..... 81/58, 60–63, 81/63.1, 63.2, 177.85

[56] References Cited

U.S. PATENT DOCUMENTS

| | | | |
|---|---|---|---|
| 455,133 | 6/1891 | Thring | 81/62 |
| 837,537 | 12/1906 | Beyer | 81/62 |
| 4,257,507 | 3/1981 | Solomon | 81/63 X |
| 4,259,883 | 4/1981 | Carlson | 81/62 |

*Primary Examiner*—Debra Meislin

*Attorney, Agent, or Firm*—Michael G. Berkman

[57] ABSTRACT

A ratchet wrench including a handle-carried drive ring and driven core in which the core can be simply and readily removed, intact, for cleaning, repair and replacement without the use of tools. Additionally, the wrench includes a low-friction ratchet drive-reversing mechanism for simple, one-finger operation. The disassembly-facilitating structure includes a resilient ring-like band seated in a channel defined by radially communicating annular grooves in the drive ring and in the wrench core. A band displacing element serves to shift the band to effect a bridging of the band across the grooves defining the channel to effect a mechanical intercoupling between the core and the drive ring of the ratchet wrench. For disassembly, the band is repositioned to assume a configuration in which the band occupies a single one only of the communicating grooves in the drive ring and in the opposed core, thereby uncoupling the core and the drive ring, to permit withdrawal of the core, as an intact unit, axially from the wrench. The drive direction of the wrench is controlled by an arcuate, wire spring which intercouples a finger-manipulable pivotal drive-reversing control plate of the tool with a shiftable pawl housed in the core of the wrench to provide a low-friction mechanism by which the pawl is positioned to establish a selectable drive direction of the wrench through simple, one-finger displacement of the reversing plate of the tool.

41 Claims, 6 Drawing Sheets

FIG. 10
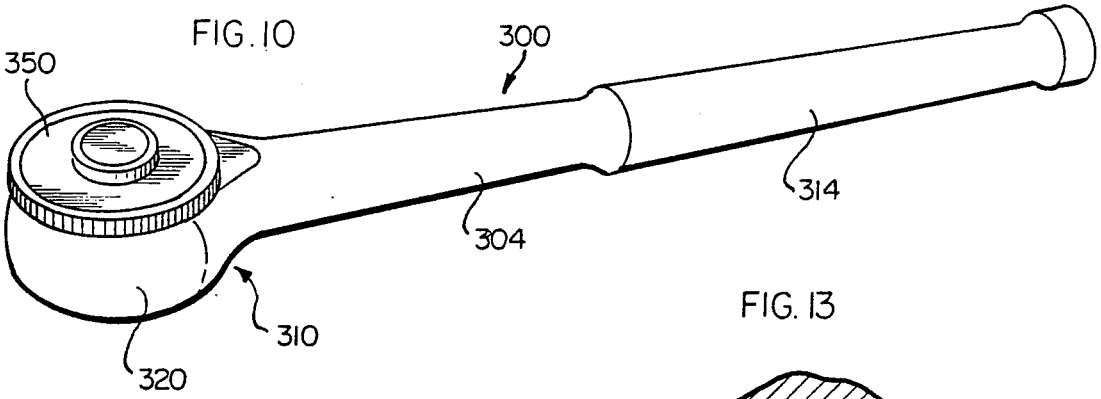
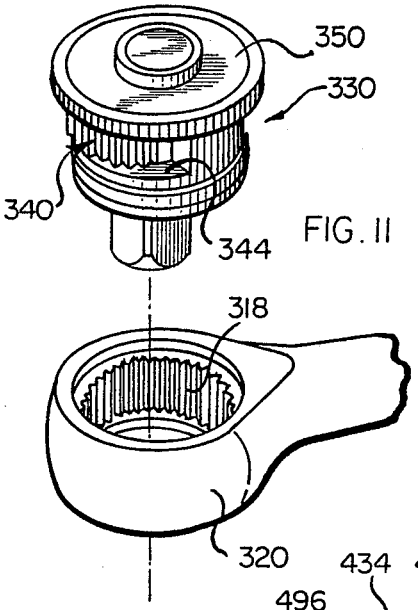
FIG. 11
FIG. 13
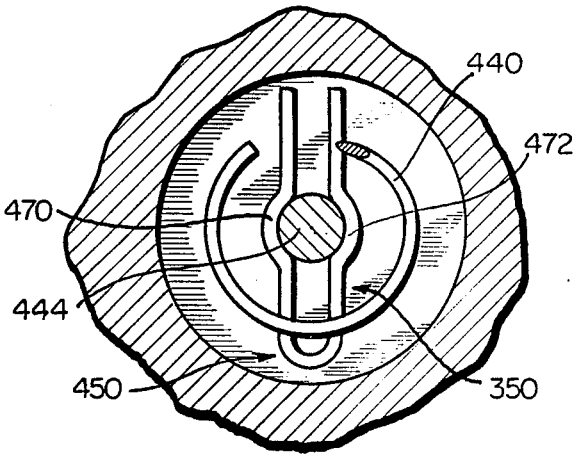
FIG. 12
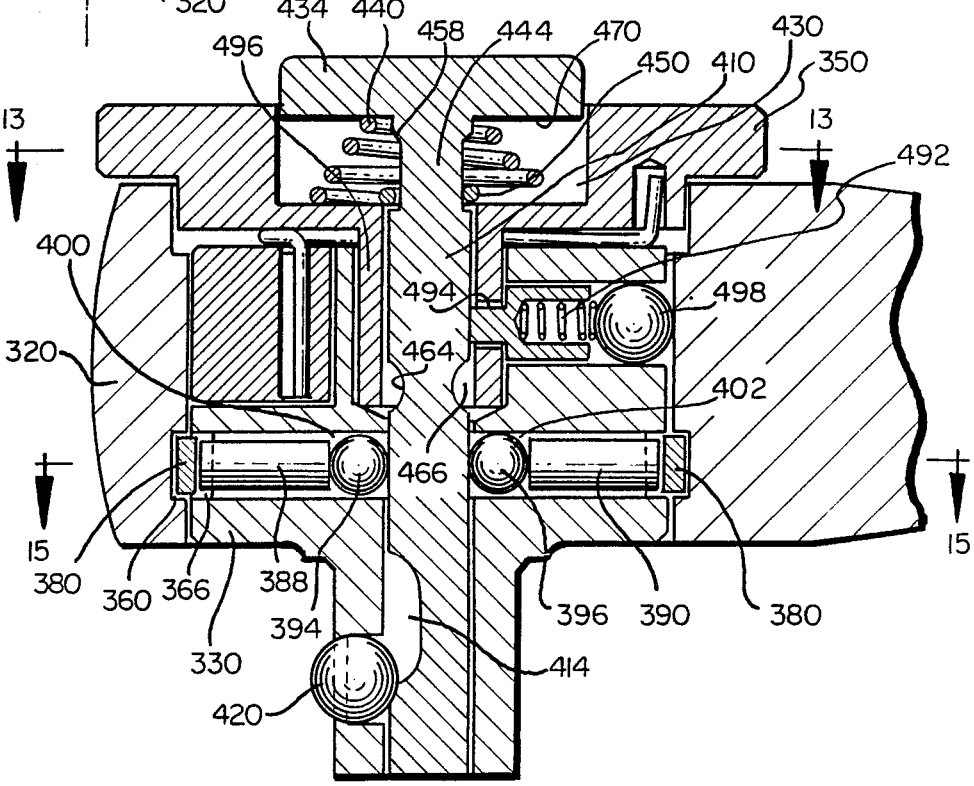

RATCHET WRENCH WITH MANUAL DISASSEMBLY CAPABILITY

The present invention relates to improved ratchet wrench structures facilitating reversal and, additionally, convenient and rapid disassembly of the wrench head without the use of tools. More particularly, the invention is directed to a ratchet wrench in which it is necessary merely to push a spring biased release element to achieve decoupling of the driven core of the wrench from the driving ring. Another important feature of the invention is use of a low-friction spring assembly for reversibly shifting the driving mode of the ratchet wrench.

BACKGROUND OF THE INVENTION

Many types of ratchet wrenches and related tools have been described in the relevant art. Typical among such wrenches are socket wrenches used to drive any of a selectable number of sockets, the functional elements of such wrenches including a handle-carried driving ring to which is coupled a driven core. The wrenches are provided with various mechanical means by which the torsional drive direction of the wrench may be readily reversed. Examples of the type of wrenches referred to are described in U.S. Pat. Nos. 4,280,379 and 4,512,218, and the entire disclosures of each of these patents is hereby specifically incorporated herein by reference to the extent that such disclosures are not inconsistent herewith.

Prior art socket driving ratchet wrenches of the type described ordinarily utilize retaining spring rings as the mechanical expedient for interlocking the internal core of the wrench within the circumscribing driving ring or collar. In order to disassemble such wreches for cleaning, replacement of parts, and for general maintenance, it is necessary that the users employ a screw driver or a pliers physically to dislodge the retaining ring. Such a procedure is inconvenient and time consuming, and replacement of the spring-like ring upon reassembly of the device is not ordinarily achieved without considerable difficulty. It is to the effective resolution of this problem and to providing an improved locking mechanism for retaining the core within the ratchet. wrench for enabling disassembly and reassembly without the use of tools that a principal facet of the present invention is directed.

Another important functional structure in ratchet wrenches of the general type of the present invention is the mechanism by which tool driving reversal is effected. Such reversal is ordinarily achieved through the expedient of a shiftable or pivotal toothed pawl which engages and intercouples with cooperating teeth formed in a drive ring. Prior art arrangements include various types of mechanical linkages for effecting displacement of a pawl housed in a cavity formed in the wrench core. The shifting of the pawl in such assemblies has invariably been conducted against significant frictional resistance so that application of considerable force has been necessary to accomplish the reversal. The present invention obviates this problem by providing a low-friction, pawl-shifting assembly so that reversal of the driving mode of the wrench can be made by means of simple, even one-finger, digital manipulation.

SUMMARY OF THE INVENTION

The present invention finds utility in a ratchet wrench of the type having a head including a handle-carried drive ring and a pawl-coupled driven body or core, the pawl being manually selectively positionable to provide two opposite driving modes for the socket which is attachable to a driving stud or boss fastened to the core itself. While the specific illustrative examples of the wrenches shown herein include such features as a longitudinally shiftable rod for releasing a detent ball so as to facilitate disengagement of the drive sockets from the wrench, this particular feature is not, per se, a critical capability or element in the present invention. Rather, the invention pertains to an improved linkage for reversing the driving mode of the wrench and to a novel structure by means of which the driven core of the wrench may be simply and effectually disengaged from the driving ring or collar, and removed from the wrench itself, without the use of tools.

Each embodiment of the present invention includes a handle-carried drive ring and a driven core in which the core can be simply and readily removed, intact, for cleaning, repair and replacement, without the use of tools. Additionally, each wrench includes a low-friction, ratchet-drive-reversing mechanism for simple one-finger operation. The wrench disassembly-facilitating structure includes a resilient ring-like spring band seated in a channel defined by radially communicating annular grooves in the drive ring and in the wrench core. A band-displacing element serves to displace or distort distort the band to effect a bridging of the band across the grooves defining the channel to effect a mechanical intercoupling between the core and the drive ring of the ratchet wrench. For disassembly, the band-displacing, band-distorting pressure is relieved, permitting the band to assume a stable, undistorted configuration in which the band occupies a single one only of the communicating grooves in the drive ring and in the opposed core, thereby uncoupling the core and the drive ring to permit withdrawal of the core, as an intact unit, axially from the wrench.

The drive direction of the wrench is controlled by an arcuate, wire spring which intercouples a finger-manipulable, pivotal drive-reversing control plate of the tool with a slidably shiftable pawl housed in the core of the wrench to provide a low-friction mechanism by which the pawl is positioned to establish a selectable drive direction of the wrench through simple, one-finger arcuate displacement of the reversing control plate of the tool.

Accordingly, it is a principal feature of the invention that the drive ring and the core of the wrench are formed with communicating annular grooves which define a channel in which an interlocking band seats, and that there are provided wrench structures selectively operable to control the positioning of the band between a first mode in which the band bridges the grooves to establish an interlocking engagement between the drive ring and the core, and a second mode in which the band occupies a single one only of the communicating grooves to decouple the drive ring and the core and to permit withdrawal of the core from the drive ring.

It is a related feature of the invention that in the absence of stressing and distortional forces applied to the spring band, the band is disposed to lie in a single one only of the annular grooves without entry into an opposed communicating other of the annular grooves, thereby to define a mechanical configuration in which the drive ring and the core are in an uncoupled relationship mode.

Yet another feature of one embodiment of the invention is that the mechanism for controlling the spatial orientation of the interlocking spring band constitutes a simple pin or probe which abuts and bears upon the spring band to distort the band to bridge the communicating grooves defining the channel which defines the housing for the interlocking spring band.

A related feature of the invention is that in each embodiment it is possible through the displacement of a finger-actuated shaft or probe to relieve the distorting pressure applied to the interlocking band, and, thus to permit the band to assume a position in which it occupies only one of the communicating grooves, thus effecting a disengagement between the drive ring and the core to permit axial displacement and separation of the core from the head of the wrench.

It is an important advantage of the present invention that there is provided a simple and highly effective structure and technique by which the internal core of the wrench may be readily and quickly separated from the drive ring for cleaning and maintenance.

In one preferred embodiment of the invention a spring biased pin operates to distort the spring band to invade both of the opposed annular grooves in the drive ring and in the core to establish an interlocking engagement of the drive ring with the core to prevent axially displacement therebetween.

In one preferred embodiment of the invention the distorting pressure applied to the spring band by the pin is relieved by pushing a manually manipulable detent into the wrench head so as to overcome biasing forces urging the pin to deform the spring band. Under the latter conditions, the spring band assumes an undisturbed or undistorted configuration in one groove only of a channel bridging the core and the drive ring, thereby mechanically decoupling the drive ring from the core to permit physical separation of the two.

In a second embodiment of the invention the pin pressure distorting the spring band is relieved by permitting the pins to retract radially into the core of the wrench. This is achieved by displacing a vertical shaft inwardly into the wrench head to align a radially inwardly depressed zone of the shaft with elements of the pin assembly so that the latter assume a position which permits the spring band to detract into the core and, thus, to decouple the core from the drive ring and to allow withdrawal of the core from the ring.

It is a related feature of the invention that in one embodiment there is provided a central axially shiftable shaft which may be pushed axially inwardly to assume, selectively, a first position in which a socket detaining ball is permitted to move radially inwardly to invade a zone of the shaft, thereby freeing the socket from the supporting boss; in a second position of further depression of the shaft inwardly into the wrench head, a second radial depression in the shaft is brought into alignment with the pin mechanism for distorting the spring band. In the latter mode, the pin mechanism moves radially inwardly to permit the spring band to retract from the drive collar, thereby permitting the core to be removed axially from the collar.

It is a feature of each embodiment of the present invention that there is provided a resilient wire which is coupled at one end to a control ring and at an opposite end to a shiftable pawl housed within a cavity of the core, whereby arcuate shifting of the control plate or ring effects a shift in the position of the toothed pawl between either of two opposing drive modes.

It is a related feature of the invention that except for its coupling to the control plate, the pawl is free to slide, unrestrained, within its cavity with minimal frictional impedance to repositioning of the pawl.

An important practical feature and advantage of the improved ratchet reversing mechanism of the present invention is that drive reversal is effectively achieved through minimal digitally applied torque impressed against a readily accessible and manipulable control plate which serves effectively, through a spring wire, to effect sliding shifting repositioning of the toothed pawl within the core cavity for sequentially reversing the drive mode of the ratchet wrench.

In a preferred embodiment of the invention, the improvements and the advantageous features are incorporated in a ratchet drive of the type which includes a driving ring or collar to which a handle is connected, a driven core or body being rotatably journaled within the drive collar and coupled thereto through a shiftable, double-ended toothed pawl. The pawl is, in turn, slidable between two limiting positions whereby either of its opposed toothed ends is brought, sequentially, into meshing engagement with mating teeth carried on the inner periphery of the drive ring for estahlishing a torque-transmitting relationship in either of opposed rotation directions. Principal features of the invention relate to the pawl-shifting mechanism and to a simple mechanical system whereby the wrench core may be readily and easily removed from the tool head for cleaning, repair, or replacement.

In accordance with the practice of the present invention, certain identified shortcomings of the prior art structures have been obviated, and a highly functional and practical device has been provided. In particular, the present invention makes it practical and feasible for the user of the ratchet drive conveniently and quickly to remove the core of the wrench for cleaning and maintenance. Additionally, the low-friction pawl-shifting mechanism enables the user of the wrench to reverse the drive direction of the wrench through simple application of minimal digitally-applied arcuate torque.

In a preferred embodiment of the invention two separate, positive manipulative steps must be carried out in order to convert the apparatus into a structural mode in which the core is decoupled from the drive ring so as to permit withdrawal of the core from the wrench head. The arrangement described obviates inadvertent decoupling or separation of the core from the ring.

Each embodiment of the present invention includes springs which serve to bias components of the structure in a fixed or stand-by mode in which the wrench head assumes an integral functional unit. In each case, application of positive axially directed pressure to components of the wrench head is an essential prerequisite to effecting the withdrawal of the core from the driving ring. It is a feature of the invention that the controlling physical components for releasing the core are readily and simply manipulated without the use of tools, and solely through manual manipulation of readily accessible wrench-carried probes or shafts.

In accordance with the practice of the present invention, above-indicated shortcomings of prior art structures have been obviated, and simple, yet highly functional and practical alternatives to prior art mechanical arrangements have been provided. In particular, the present invention makes it possible for the wrench user conveniently and quickly to disassemble the head without the use of tools. Safeguards are provided so that disassembly will not occur inadvertently.

Other and further objects, features and advantages of the invention will become evident upon a reading of the following specifications taken in conjunction with the drawings.

BRIEF DESCRIPTION OF THE DRAWINGS

FIG. 10 is a perspective view of a second embodiment of the ratchet wrench of the invention;

FIG. 11 illustrates the wrench of FIG. 10 with the core removed, intact, as an unitary assembly;

FIG. 12 a cross-sectional view of the tool head taken substantially on the lines of 12—12 of FIG. 10 and showing the core and drive ring interlock and release assembly in the second embodiment of the invention, and in a locking mode of the core with the driving ring;

FIG. 13 is a cross-sectional view taken substantially on the lines 13—13 of FIG. 12 and showing a shaft-support spring and a retaining clip facilitating two-stage controlled axial advance of the shaft to effect, first, tool release, and, there disengagement between the core and the drive ring;

DESCRIPTION OF THE PREFERRED EMBODIMENTS

Figure 1:
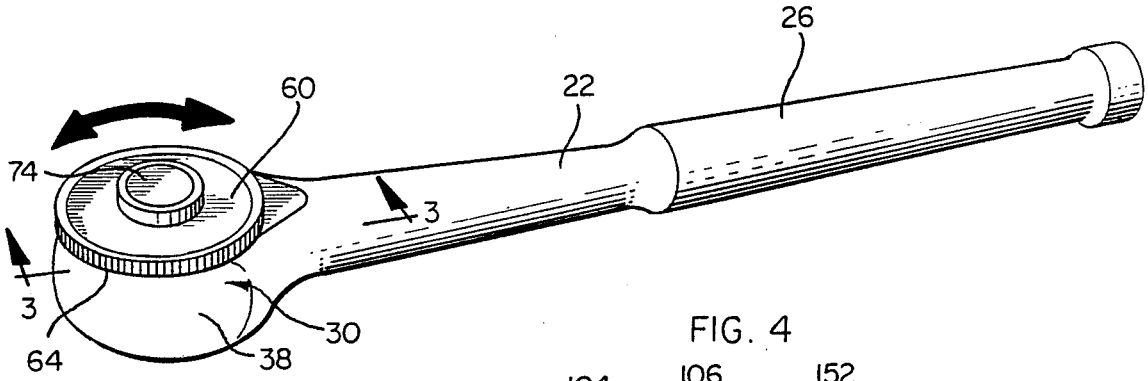
FIG. 1 is a perspective view of one embodiment of the ratchet wrench of the invention and showing the finger-actuable drive-reversing control plate.
Figure 2:
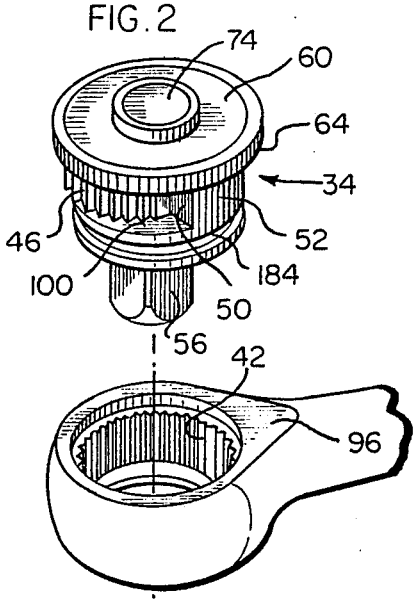
FIG. 2 is a view of the tool head of the wrench of FIG. 1 and showing the core removed from the drive ring, intact, as a unitary assembly.

The aims, objects, and advantages of the invention are achieved by providing as component structural parts of a ratchet-drive wrench, unique mechanical arrangements by means of which the wrench may be disassembled and reassembled for maintenance, cleaning, repair and replacement of operating components. The invention is characterized in that spring-biased locking pin assemblies function, in conjunction with associated cooperating mechanical elements, in a manner such that simple mechanical operation or manipulation is effective to displace the locking pin element or to permit displacement cf the pin element within the wrench head and to affert forces acting upon a locking spring band to achieve disengagement between the core and the driving ring of the wrench so that the core may be easily removed from the wrench head. In each preferred embodiment of the invention described below, the locking pin assembly is manipulated or shifted by means of shafts or rods which project from the wrench head so as to be readily accessible, thus facilitating simple digital manipulation of the controlling elements. The arrangements described permit physical separation of the core from the circumscribing collar or ring. Manipulation of the release mechanisms and disengagement of the core and ring components from each other are achieved digitally or manually, without any need for tools of any type.

Each of the several preferred embodiments of the invention has, in common with the others, internal mechanical structures by means of which a spring band which intercouples and interlocks the drive ring and the core may be readily shifted or manipulated through the application of digital pressure for effecting disengagement between the wrench core and the drive ring, thus facilitating disassembly of the wrench head for maintenance, cleaning, and repair. Each of the several embodiments of the invention also includes a low friction assembly in which a control plate is functionally coupled to a slidably shiftable pawl so that the pawl is readily manipulable through application of digitally effected torque to the control plate to effect a reversal of the torque-transmitting linkage so as to achieve, selectively, clockwise and counter-clockwise rotation of the driven core or body of the tool.

The internal structure of the wrench core assembly itself and the associated pivotally-confined pawl and toothed driving ring in the illustrated embodiments of the wrench are not in any sense critical. Such internal structures do not constitute, per se, elements of the present invention, except insofar as specific novel features are pointed out hereinafter.

The present invention finds utility, generally, in a broad class of ratchet wrenches including wrenches of the type in which the wrench-secured drive socket is releasable by displacing a wrench shaft axially inwardly of the wrench body to release a socket-securing detent ball.

Referring now to the drawings, there are shown, for illustrative purpopes and not in any limiting sense, preferred embodiments of the structural elements fcr reversing the driving mode of the wrench and for interlocking the wrench core with the drive ring ard for effecting disengagement between the ring and the core components for disassembly of the wrench head.

In the embodiment of the invention illustrated in FIGS. 1–9, the ratchet wrench 20 is illustrated as including an elongated handle 22 having a hand-grid section 26 and terminating at its opposite end in a drive head 30. The drive head 30 includes a driven. body or core 34 rotatably journaled in a generally cylindrical driving ring or collar 38. The latter is formed on its inner, generally cylindrical surface with an uninterrupted series of axially extending ratchet teeth 42 for engaging a toothed pawl 46 seated in a cavity 50 formed in the body 52 of the core 34 and opening radially outwardly of the core.

Figure 3:
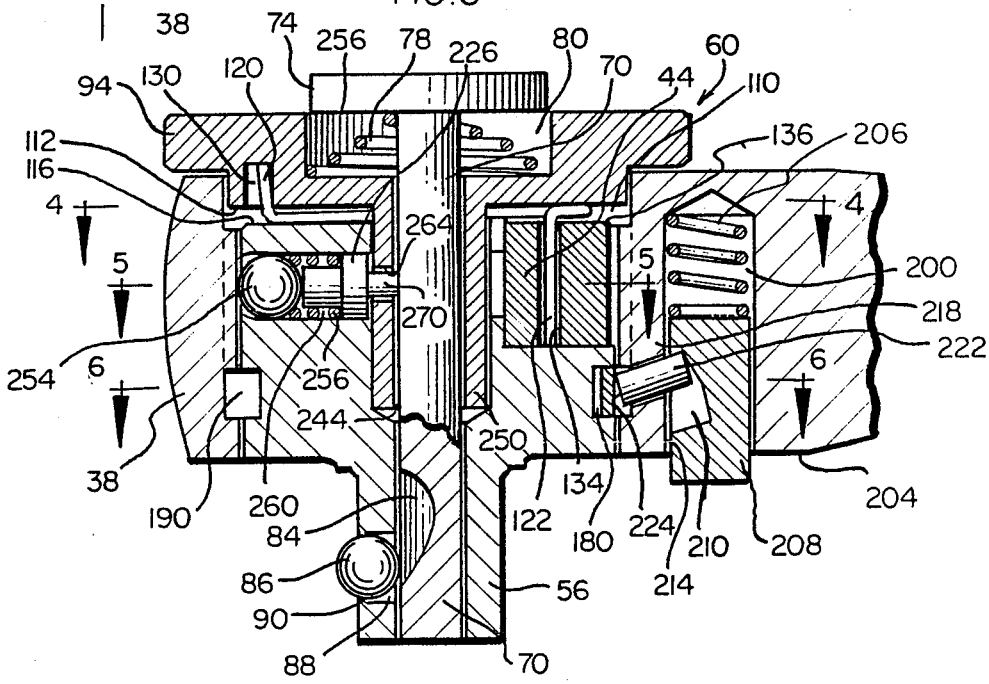
FIG. 3 is a cross-sectional view of the head of the wrench taken substantially on the lines 3—3 of FIG. 1 and showing the core and drive ring interlock and release assembly and the control-plate-actuated pawl-reversing wire of the invention.

The core 34 terminates at its lower extremity in a stud or boss 56 for attachment of interchangable tool elements such as drive sockets (not shown). At its opposite end, the core body 52 is formed with an enlarged-diameter, collar-like flange or plate 60, a bounding peripheral marginal edge of which is knurled 64 to facilitate manual or digital rotation thereof as more fully explained herebelow. The core 34 of the ratchet head 30 includes a shaft 70 extending axially through the core 34 and terminating at its upper end in a cap 74, the latter surmounting a compression spring 78 encircling the shaft 70 and housed in a cavity or recess 80 opening upwardly of the plate 60 and in which the cap 74 is disposed to move telescopically upon application of manual pressure downwardly on the cap 74 and the shaft 70 attached thereto, (FIG. 3). The lower portion of the shaft 70 is formed with a dished or cut-out zone 84 which serves as a recess for receiving a drive socket release ball 86 confined in a radially extending bore 90 in the tool-coupling stud 56 of the core assembly 34. The spring 78 biases the shaft assembly axially upwardly so that a lower portion of a camming face 92 of the dished zone 84 urges the socket release ball 86 radially outwardly stressingly to abut a presented wall of a socket (not shown) positioned in place on the stud 56 of the tool head 30. Conversely, axially downward displacement of the shaft 70 against the pressure of the biasing spring 78 brings the cut-out zone 84 into radial alignment with the bore 90 in the stud 56 to permit the detent ball 86 to move radially inwardly and to free a socket from the driving boss 56, in accordance with similar structures known in the relevant art.

The foregoing description of general structures is directed primarily to features of ratchet wrench assemblies which find their counterparts in prior art devices. Such features have been described herein primarily for the purpose of indicating a particular structural environment in which the present invention finds utility. The invention itself will become clear from the following detailed description.

Figure 4:
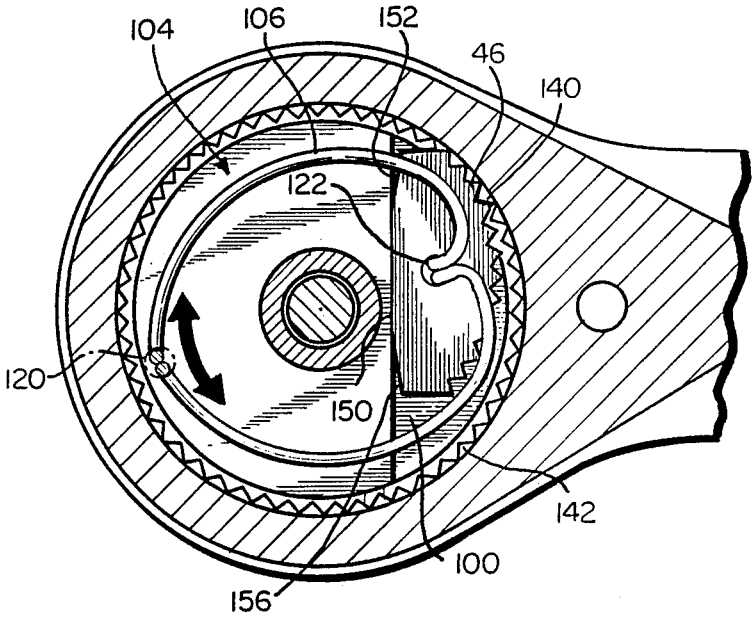
FIG. 4 is a cross-sectional view taken substantially on the lines 4—4 of FIG. 3 and showing one embodiment of the annularly shiftably pawl-reversing wire, and the pawl in a given mode.
Figure 5:
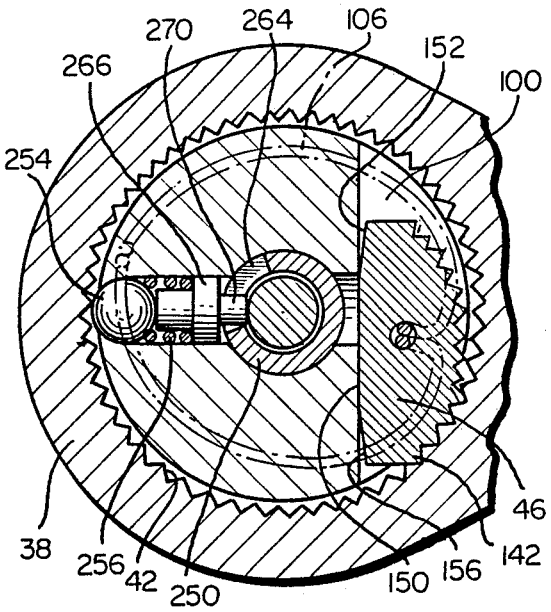
FIG. 5 a cross-sectional view taken substantially on the lines 5—5 of FIG. 3 and showing a mechanism for defining and limiting annular displacement of the control plate, and depicting the pawl shifted to a tool-driving mode opposite that shown in FIG. 4.

That facet of the present invention which relates to the structure by which the toothed pawl 46 is shifted, sequentially, in the core cavity for effecting, in turn, opposed driving modes of the ratchet wrench is described herebelow with reference to FIGS. 3–5. As shown, the outer diameter of the core body 52 is only slightly less than the inner diameter of the drive ring 38 so that the core 52 is rotatably received and supported within the drive ring 38 with an enlarged annular flange 94 of the control plate 60 abutting a top face 96 of the drive ring 38. As shown (FIGS. 4 and 5), the toothed pawl 46 is slidably supported on a base or floor 100 in the core cavity 50 formed in the core body 52. Mechanical linkage between and control of the positioning of the pawl 46 through the control plate 60 is achieved, in each of the embodiments of the invention illustrated, by means of an intercoupling, resilient, spring-like wire 104 which, in one preferred embodiment of the invention (FIG. 4) includes an arcuately curved body portion 106 disposed generally horizontally in a cavity 110 between the lower surface 112 of the control plate 60 and a top surface 116 of the principal body portion 52 of the core 34. The curved body 106 of the wire 104 is integrally formed with parallelly disposed probe-like ends 120 and 122 projecting in opposite directions and generally normally of a plane defined by the body portion 106 of the wire 104. As shown in FIG. 3, an end 120 of the spring wire 104 projects into a socket 130 extending upwardly into the control plate 60 from a lower face 112 thereof. The opposite probe 122 projects downwardly into a bore 134 extending normally into the pawl 46 from a top face 136 thereof. In a preferred embodiment of the invention and as indicated in FIGS. 4 and 5, two separate but coacting resilient wire assemblies are utilized. Upon consideration of the above description in conjunction with the drawings, it is clear that arcuate shifting of the control plate 60 is effective through the resilient spring-like wire 104 to impose a sliding torque upon the coupled pawl 46 to effect a shift or a lateral displacement of the pawl 46 within the pawl housing 50 so that the opposed toothed end portions 140 and 142 engage, sequentially, cooperating teeth 42 of the drive ring 38 to establish opposite drive modes of the ratchet wrench. As shown in FIGS. 4 and 5, that face 150 of the pawl 46 opposed to the pawl teeth is chamfered or beveled 152 and 156 to reduce frictional forces between the pawl 46 and the core body 52 thereby enhancing the ease with which drive reversal is accomplished.

Figure 8:
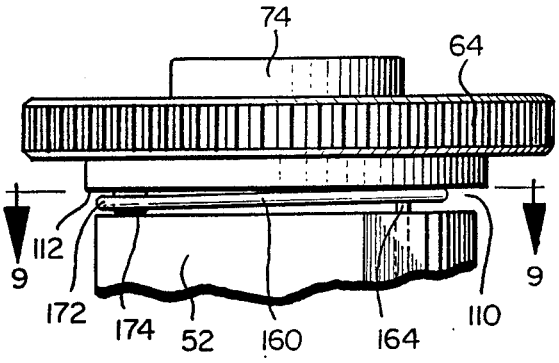
FIG. 8 is a fragmental view of the core of the wrench and showing the control plate and the shiftable pawl coupled through a resilient wire.
Figure 9:
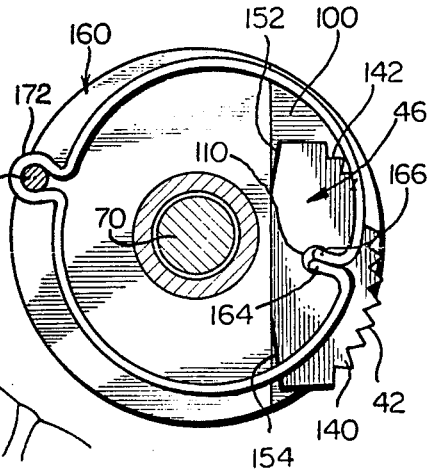
FIG. 9 is a cross-sectional view taken substantially on the lines 9—9 of FIG. 8 and indicating an alternative arrangement of a wire for connecting the control plate of the shiftable pawl.

A second, somewhat modified form of the drive-reversing spring wire arrangement for shifting the pawl 46 is indicated in FIGS. 8 and 9. As shown, the spring wire 160 is generally circular in form and includes at its ends probe-like stubs or arms 164 and 166 which extend into a cooperating bore 170 opening upwardly of the pawl 44 (FIG. 9). In a generally mid-zone of the wire diametrically opposed to the probes 164 and 166, the wire 160 is formed with a loop 172 trained about and grippingly engaging a post 174 attached to and projecting downwardly from an underface 112 of the control plate 60. The operation of this embodiment of the spring wire is essentially the same as that of the wire assembly shown in FIG. 4.

The structure which serves, in accordance with the invention, to retain the wrench core and the driving collar in an assembled mode and which permits ready and simple disengagement between the core and the drive ring to enable axial withdrawal of the core from the drive ring, intact as a unitary assembly, and without the use of tools, is described below with reference to FIGS. 3, 6 and 7. As shown, the drive ring 38 and the core body 52 are formed with opposed and intercommunicating annular grooves 180 and 184 which define a channel bridging and bounded by the drive ring 38 and the core 52. An arcuate, ribbon-like, spring band 190 confined within the channel 192 formed by the opposed grooves 180 and 184 serves as an interlock by means of which the drive ring 38 and the core 52 are intercoupled for interlocking engagement and to resist axial displacement or separation.

Figure 6:
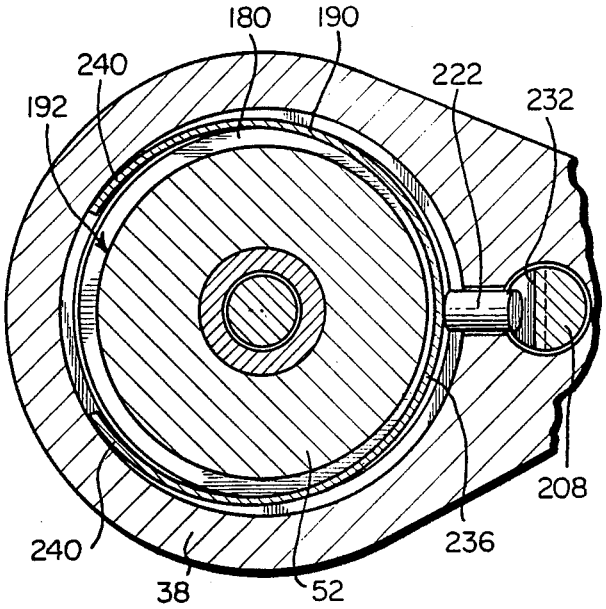
FIG. 6 is a cross-sectional view taken substantially on the lines 6—6 of FIG. 3 and showing a pin stressingly engaging the spring band to effect a mechanical interlock between the drive ring and the core, according to one embodiment of the invention.
Figure 7:
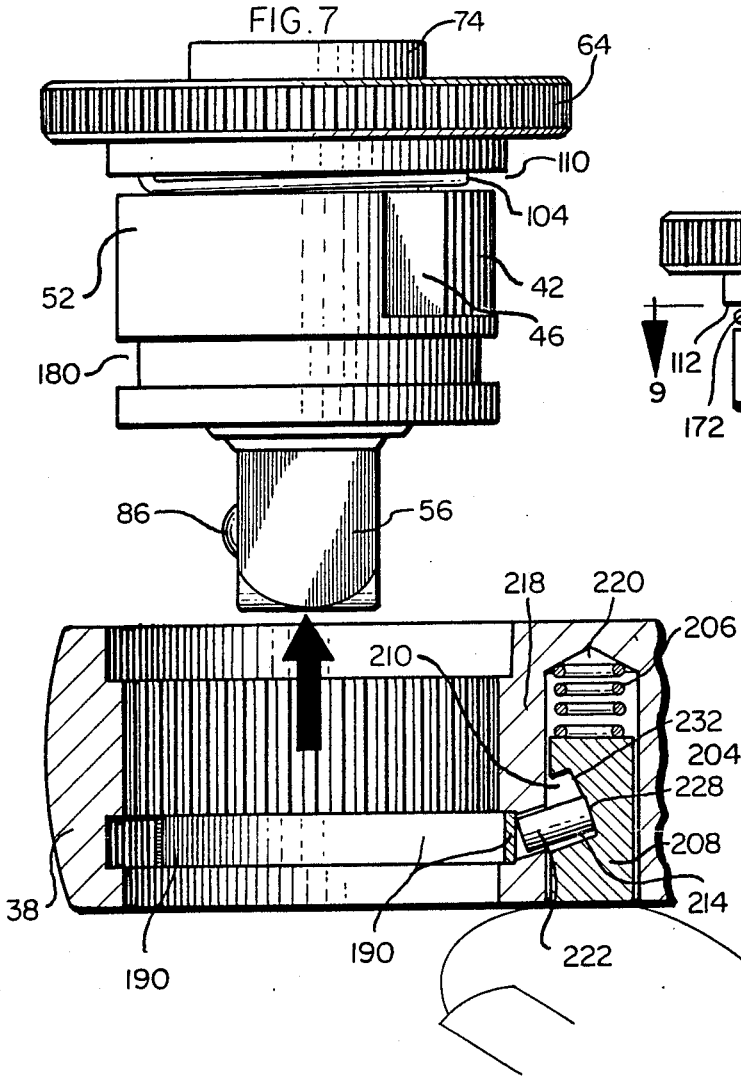
FIG. 7 is a view showing the core of the wrench lifted from the drive ring of the tool head and indicating schematically retraction of the spring-band-distorting pin radially outwardly to relieve pressure applied to the spring band, upon digital displacement of a control button inwardly against the opposing pressure of a biasing spring.

In the embodiment of the invention depicted in FIGS. 3, 6 and 7, the spring band 190 is biased to expand radially so that in its "free" undistorted configuration, the band 190 assumes a position in which it is totally within the groove 184 in the drive ring or collar 38, as shown in FIG. 7. In this mode or orientation, the core body 52 and the associated control plate 60 and pawl reversing mechanism may be withdrawn axially from the driving ring 38, as shown in FIG. 7.

The mechanism by which the spring band 190 is distorted to bridge the channel 192 so that at least a portion of the spring band 190 enters into the groove 180 in the core 52 is shown in FIGS. 3 and 6. The tool head 30 is formed with a bore 200 opening at an underface 204 of the tool head (FIG. 3). A spring 206 is confined in the bore 200 by a digitally manipulable, telescopically shiftable plug or detent 208, and the detent 208 is formed with a cutout section 210 communicating with a passage 214 extending through the bounding wall 218 of the drive ring 38 and communicating with the channel 192 in which the spring band 190 is confined. Slidably disposed within the passage 214 is a pin 222, an inwardly directed end 224 of which abuts and bears upon the spring band 190. The opposite end 228 of the pin 222 abuts and bears upon a camming wall surface 232 bounding the cavity 210. Thus, in the operational mode of the assembly depicted in FIG. 3, the spring 206 bears upon the digitally shiftable plug 208, the latter in turn displacing the pin 222 inwardly toward the core 34 and into abutment with the spring band 190 to position at least a lineal section 236 of the spring band 190 within the groove 180 in the core 34 (FIGS. 3 and 6). At the same time, a more remote lineal section 240 of the spring band 190 occupies the groove 184 in the drive ring 38 so that the spring band 190 serves effectively mechanically to intercouple the drive ring 38 with the core 52 to prevent axial separation of the two.

The ratchet drive wrench of the invention, in its operational or functional mode, is shown in FIG. 3. In order to separate, detach, or withdraw the core 52 of the wrench from the drive ring or drive collar 38, and as indicated schematically in FIG. 7, it is necessary merely to depress the plug 208 axially inwardly into the wrench head 30. This permits the pin 222 to move radially outwardly and away from the core 52 and permits the resiliently biased spring band 190 to move out of the groove 180 in the core 52 and seat totally within the outer groove 184 of the channel 192, thereby decoupling the core 52 from the drive ring 38 and permitting axial withdrawal of the core 52 from the ring 38, all as indicated schematically in FIG. 7.

As further shown in FIG. 3, the control plate 60 is integrally formed with a downwardly extending, open pipe-like extension or tube 244 in which the shaft 70 of the socket releasing assembly is slidably and reciprocally confined. In order to prevent the inadvertent separation of the control plate 60 and its depending pipe-like section 250 from the core 52, there is provided an interlock assembly which, in the specific embodiment of the invention illustrates, includes a ball 254 and spring 256 confined in a cavity 260 formed in the body 52 of the core 34 and communicating with a bore 264 extending radially into the pipe wall 250 of the control plate assembly. The spring 256 bears upon a piston-like plate 266 which is reciprocably slidable in the chamber 260 and which is connected at its radially inwardly directed face to a rod-like probe 270 which extends into the opening 264 in the wall 250 which embraces the reciprocally secured shaft 70, the probe 270 serving as a key to obviate inadvertent disassembly of the control plate 60 and its associated structure from the wrench head 30.

A second embodiment of the invention is described below with reference to FIGS. 10–16. As shown, the wrench 300 includes an elongated shaft 304 attached at one end to a wrench head 310 and at its opposite end to a handle 314. The wrench head 310 includes an internally toothed 318 drive ring 320 and a core 330 which is rotational within the drive ring 320, a toothed pawl 340 shiftable within a cavity 344 for reversing the drive direction, the drive reversal structure and the linkage between a drive control plate 350 and the shiftable pawl 340 corresponding to structures previously-described with respect to the first embodiment of the invention As in the first embodiment of the invention, depicted in FIGS. 1–9, the second form of the invention defines a structure enabling the ready and simple withdrawal and removal of the core 330 from the drive ring 320, without the use of tools, to facilitate maintenance, cleaning, repair and replacement of component parts. It is the particular specific mechanical components and their arrangement for facilitating the ready removal of the core 330 from the wrench head 310 that distinguishes the second embodiment of the invention from the first. Referring now to FIG. 12, there is shown the structure and the arrangement of components when the wrench is in its operational mode, that is, with the core 330 locked within the drive ring 320. As previously described with reference to the first embodiment of the invention, the drive ring 320 is formed with a circumscribing interior groove 360 opposed to and communicating with an outwardly opening circumscribing groove 366 formed in the body of the core 330 to define an annular channel 370 which serves as a housing for arcuate spring band 380 which serves as the mechanical interlock between the core 330 and the drive ring 320, as more fully explained herebelow.

Figure 14:
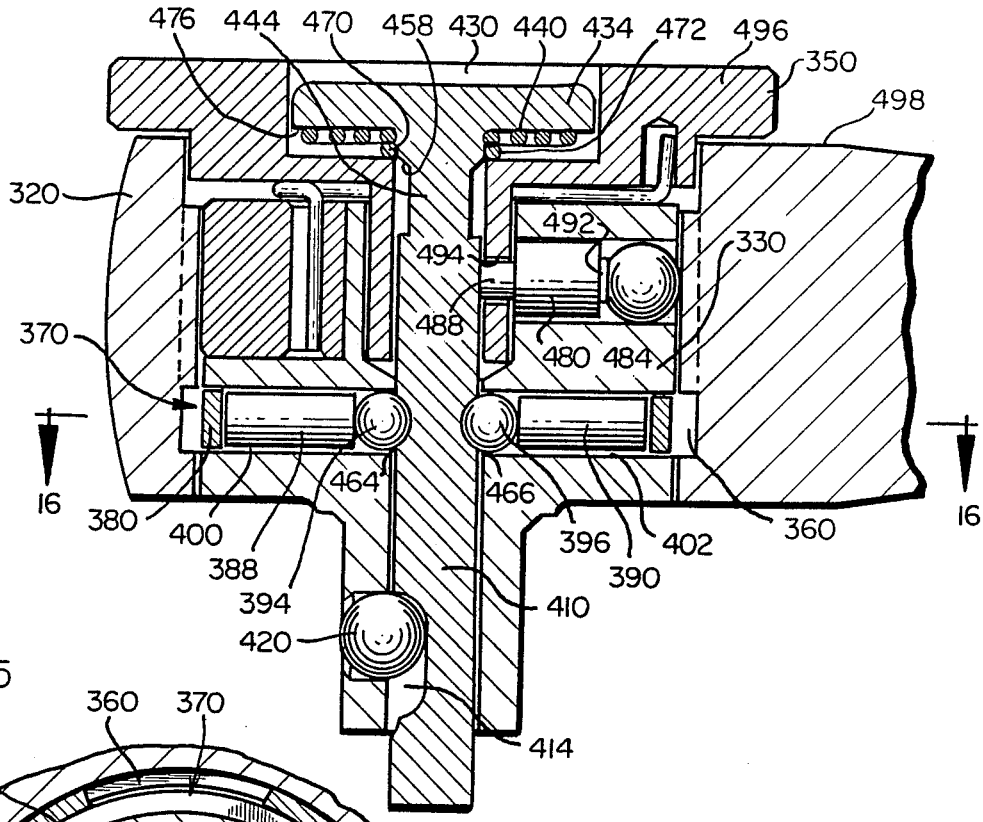
FIG. 14 is a cross-sectional view similar to that depicted in FIG. 12 but showing the control shaft fully displaced against biasing spring elements and aligned to allow the interlocking spring band to retract from engagement with the drive ring to permit telescopic separation of the core assembly from the drive ring.
Figure 15:
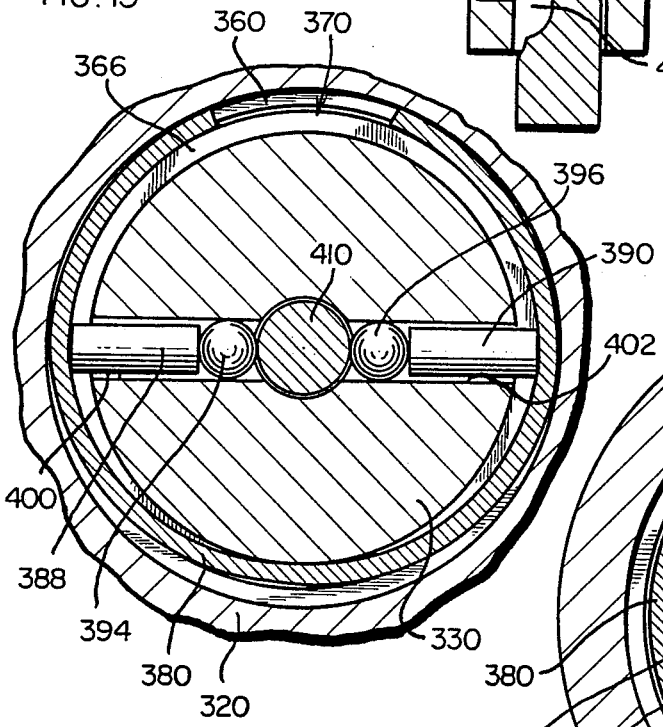
FIG. 15 is a cross-sectional view taken substantially on the lines 15—15 of FIG. 12 and showing the core and drive ring interlocking band distended to assume an interlocking mode of the assembly.
Figure 16:
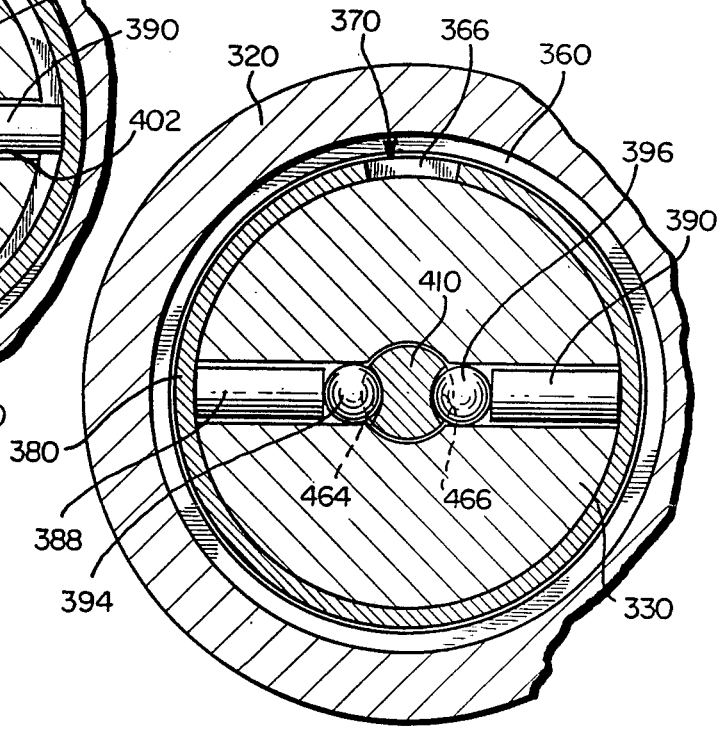
FIG. 16 is a cross-sectional view taken substantially on the lines 16—16 of FIG. 14 and showing the core and drive ring interlocking band in an undistorted, core-freeling configuration mode.

In the embodiment of the invention illustrated in FIGS. 12–16, the spring band 380 is biased to contract radially so that, unless subjected to positive distortional forces, the spring band 380 would assume a position totally within the "inner" groove 366 formed in the core 330 so that the core 330 would be mechanically decoupled from the drive ring 320, as shown in FIGS. 14 and 16, thus permitting withdrawal of the core 330 from the encircling drive ring 320.

Referring now more particularly to FIG. 12 and to FIG. 15, the spring band is shown as urged radially outwardly by means of a pair of annularly spaced, radially directed band-displacing assemblies which, in the specific embodiment of the invention illustrated, comprise a pair of push rods 388 and 390 each in abutment with and in radial alignment with a cooperating ball 394 and 396 in corresponding radially extending through bores 400 and 402 in the body of the core 330. In the specific arrangement shown, the push rods 388 and 390 abut, at outwardly directed ends thereof, and stressingly engage the spring band 380. At their opposite ends, the push rods 388 and 390 abut the balls 394 and 396, the latter contacting, at their diametrically opposed ends of each ball a shaft 410 extending axially through the head 310, including the core 330 of the wrench and supported for reciprocal longitudinal movement therewithin.

As described with reference to the first embodiment of the invention, the reciprocal shaft 410 is formed in a lower zone thereof with a recess 414 opening radially outwardly of the shaft for receiving therewithin a socket-securing detent ball 420 when the shaft 410 is urged axially downwardly into the assembly to bring the recess 414 opposite the ball 420, all in accordance with procedures known and previously described.

As in the case of the first embodiment of the invention, the drive reversing control plate 350 is formed with an upwardly opening cavity 430 in which a cap 434 which surmounts the shaft 410 of the head is received for telescopic reciprocal motion therewithin. Interposed within the cavity 430 and biasing the shaft 410 and the surmounting cap 434 to an upwardly extended limit is a spring 440, and beneath this spring and grippingly engaging the shaft 410 at a diametrically reduced neck portion 444 thereof is a spring clip 450. The shaft 410 is formed at a zone adjacent the underside of the cap 434 with a radially enlarged collar 454 joined to the neck portion 444 of the shaft 410 by a flared or frustoconical section 458.

In FIG. 12, the structure illustrated depicts the mechanism in a mode in which the spring band 380 is physically distorted in zones abutting and stressingly engaging the ball and pin assemblies 394 and 388 and 396 and 390 so that the spring band 380 bridges the channel 370 formed by the grooves 360 and 366, with portions of the band 380, which is normally confined to the inner grooves 366, being urged radially outwardly so that arcuate sections of the band 380 invade the outer groove 360 of the assembly so as mechanically to interlock the core 330 within the driving ring 320 (FIG. 15).

Physical conversion of the assembly into a mode in which the core 330 may be readily withdrawn from the driving ring 320 is described below with reference to FIGS. 12, 14 and 16. As shown, the shaft 410 is formed in a medial zone of its linear expanse with a pair of opposed recesses or sockets 464 and 466 which are diametrically opposed as shown in FIGS. 12 and 14. Upon applying digital pressure to urge the cap 434 and the shaft 410 attached thereto axially inwardly into the head 310 of the wrench, the spring 440 is compressed and the frustoconical section 458 of the upper portion of the shaft 410 comes into physical abutment against the opposed arms 470 and 472 of the clip 450. With this, initial degree of axial displacement of the shaft 410, the cavity or recess 414 at the lower portion of the shaft is brought into a position opposing the detent ball 420 so that the latter enters the recess 414 to permit ready removal of a tool-driving socket (not shown).

Upon the application of additional pressure to the cap 434, the frustoconical section 458 at the top of the shaft neck 444 displaces the arms 470 and 472 of the clip 450 radially outwardly, whereupon the advance of the shaft downwardly into the core continues until the underside 476 of the shaft-surmounting disk or plate 434 bears upon the arms 470 and 472 of the clip 450. In the latter degree of axial displacement, the shaft sockets or recesses 464 and 466 are brought into a position in which they oppose or fall in line with the spring band pin and ball 388, 394 and 390, 396 so that the radia11y inwardly presented portions of the balls 394 and 396 are received respectively in the sockets 464 and 466, as shown in FIGS. 14 and 16. Under the conditions described, the spring band 380 is permitted to contract radially to assume an undistorted configuration totally within the annular groove 366 in the core 330, as shown in FIG. 16. Tae spring band 380 then no longer serves an interlock mechanism, and the core 330 may be readily withdrawn from the drive ring 320.

As described with reference to the embodiment of the invention illustrated in FIG. 3, there is provided in the second embodiment of the invention (FIGS. 12 and 14) a locking assembly comprising a piston-like element 480 sleeved in a cylinder-like cavity 484 in the body of the core 330 and terminating in a radially inwardly directed key or probe 488 urged resiliently by means of a spring 492 to interlock within a port 494 formed in a pipe-like sleeve 496 depending from the control plate 350 and enveloping the shaft 410. A ball 498, also housed within the cavity 484, abuts the spring 492 to complete the mechanism for retaining the control plate and its depending skirt 496 locked within the core 330 of the wrench 300.

A third embodiment of the invention is described below with reference to FIGS. 17–22. As shown, the wrench 500 includes an elongated shaft 504 attached at one end to a wrench head 510 and at its opposite end to a handle 514. The wrench head 510 includes an internally-toothed 518 drive ring 520 and a core 530 which is rotational within the drive ring 520. A toothed 534 pawl 540 is shiftable within a cavity 544 in the core body for reversing the wrench drive direction, the drive reversal structure and the linkage between a drive control plate 550 and the shiftable pawl 540 corresponding to structures previously described.

Figure 17:
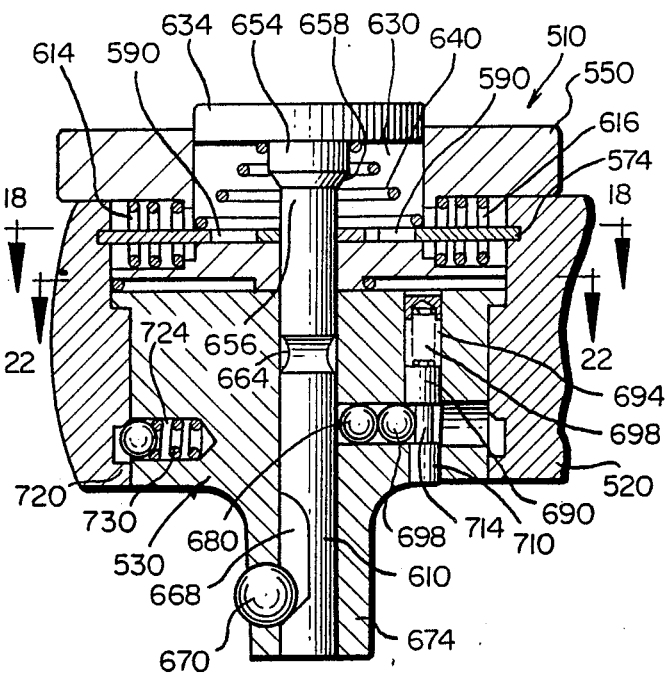
FIG. 17 is a cross-sectional view taken vertically through the head of the third embodiment of a ratchet wrench according to the invention and showing the core retained in a locking mode within the driving ring and with the socket retaining detent in a mode to hold a socket in place.
Figure 18:
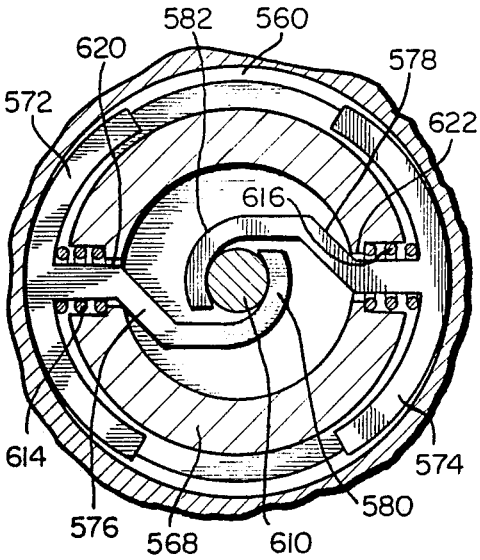
FIG. 18 is a cross-sectional view taken substantially on the lines 18—18 of FIG. 17 and showing the core and driving ring interlocking plates extending radially outwardly in a core interlocking mode of the assembly.

As in the case of the earlier-described embodiments of the wrench, the wrench of FIGS. 17–22 also includes a structure enabling the ready and simple withdrawal and removal of the core 530 from the drive ring 520 without the use of tools. FIGS. 17 and 18 depict the wrench in its operational mode, with the core 530 locked within the drive ring 520. As in the case of the other embodiments of the wrench, the drive ring 520 is formed with a circumscribing interior groove 560 opposed to and communicating with an outwardly opening circumscribing groove formed in a downwardly-extending neck-like portion 568 of the drive reversing plate 550. The opposed, communicating grooves 560 in the drive ring 520 and 566 in the core component 568 accommodate laterally shiftable arcuate plates 572 and 574 which function as mechanical interlocks for intercoupling the core 530 with the drive ring 520.

As shown in FIGS. 17 and 18, the locking plates 572 and 574 are integrally formed with respective radially-inwardly directed arms 576 and 578 which terminate in hook-like ends 580 and 582. The arms 576 and 578 and the hooked ends 580 and 582 of the anchor-shaped interlocking devices 586 and 588 extend through radial passages 590 formed in the neck 568 so that the hook-like ends 580 and 582 encircle to embrace a shaft 610 which extends axially through the head 510 and through the core 530 for reciprocal longitudinal movement therewithin. A pair of springs 614 and 616 disposed to encircle the arm portions 576 and 578 of the interlock assemblies 586 and 588 and which are confined in accommodating chambers 620 and 622 opening radially outwardly of the neck 568 of the control ring 550 bias the locking mechanisms 586 and 588 outwardly to invade the groove 560 in the drive ring 520 for establishing interlocking engagement between the drive ring 520 and the core 530, as shown in FIGS. 17 and 18.

As shown in FIG. 17, the control plate 550 is formed with an upwardly-opening cavity 630 which accommodates a cap 634 which surmounts the shaft 610. A spring 640 encircling the upper portion of the shaft 610 biases the cap 634 and the shaft 610 attached thereto to an upwardly-extended limit. The shaft 610 is formed at an upper end adjacent the cap 634 with a radially-enlarged collar 654 joined to the upper end 656 of the shaft proper 610 by a frustoconical section 658. As in the previously-described embodiment of the invention, the shaft 610 is formed adjacent a medial zone with a circumscribing annular recess 664. At a lower end portion of the shaft 610 the latter is formed with a recess 668 for accommodating a detent ball 670 confined in a tool-coupling stud 674 of the core 530.

Figure 19:
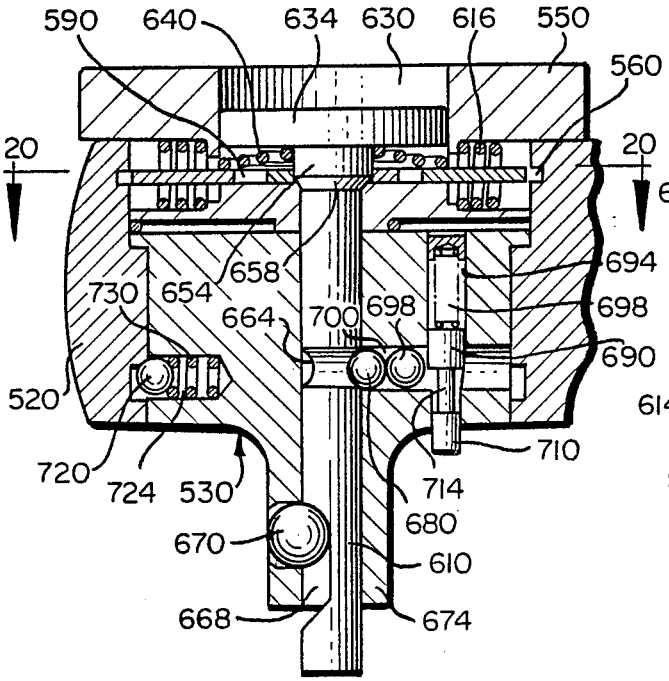
FIG. 19 is a vertical cross-sectional view similar to that of FIG. 17 but showing the core and drive ring assembly in a core-releasing mode and the socket detent in a socket-releasing position.
Figure 20:
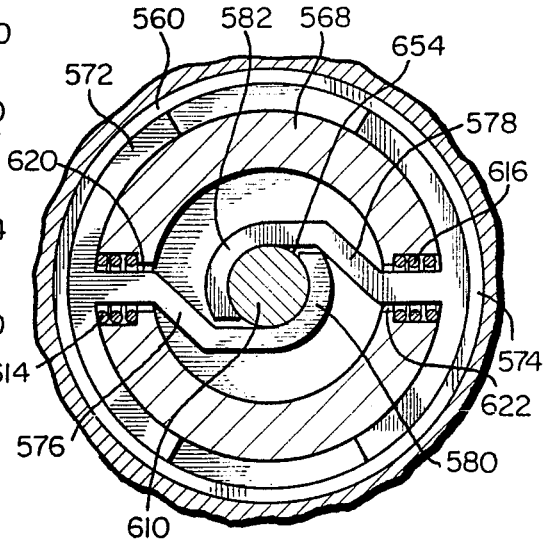
FIG. 20 is a cross-sectional view taken substantially on the lines 20—20 of FIG. 19 and showing the core and drive ring interlocking plates pulled radially inwardly in a core-releasing mode.

The mechanism by which the assembly of FIGS. 17–22 is transformed into a mode in which the core 530 is removable from the drive ring 520 is described with reference to FIGS. 17–20, and particularly with reference to FIGS. 19 and 20. As indicated schematically in FIG. 19, upon the application of digital force applied axially downwardly on the cap 634 surmounting the shaft 610, against the pressure of the biasing spring 640, the frustoconical section 640 bears upon and cams the hook-like ends 580 and 582 of the locking elements 586 and 588 radially outwardly and the enlarged neck portion 654 of the shaft 610 engages the hook ends 580 and 582 displacing the latter radially outwardly with the effect of pulling the arcuate plates 572 and 574 of the locking mechanism radially inwardly into the core 530 and out of engagement with the drive ring 520, the assembly assuming the configuration depicted in FIG. 20.

With the same full degree of depression of the shaft 610, the annular groove or recess 664 in the shaft 610 assumes a position opposed to a detent or locking ball 680, the latter entering the groove 664 to effect a mechanical coupling between the shaft 610 and the core body, locking the shaft 610 in its downwardly extreme limit, with the core 530 and drive ring 520 interlock plates 572 and 574 in a core releasing mode, where upon the core 530 may be lifted from and readily separated from the enveloping drive ring 520.

The mechanism for urging the detent ball 680 into the cooperating recess 664 is shown in FIGS. 17 and 19. Referring first to FIG. 17, a release pin 690 reciprocably mounted in a vertically-extending slot or bore 694 is biased downwardly by a spring 698 so that a lower radially enlarged section of the pin 690 abuts and bears upon a ball 698, the latter being confined in the same channel 700 as is the detent ball 680 so that laterally-displacing forces impressed on the ball 698 are transferred in turn to the detent ball 680. Accordingly, when the shaft 610 is depressed to bring the groove 664 opposite the detent ball 680, the ball enters the groove 664 to lock the shaft 610 in its downwardly displaced disc position. Referring now to FIG. 19, with the locking pin 690 in its downward position, a lower end 710 of the pin extends as a projection beyond the base or bottom of the core 530. When one desires to reposition and to lock the core 530 within the drive ring 520, it is necessary merely to insert the core in place and then to push upwardly on the extension 710 of the locking pin 690. The pressure of the locking pin 690 is thus removed from the detent assembly, including the balls 698 and 680 as the ball 698 enters into a space afforded by a sector 714 of the locking pin, that sector having a reduced diameter, all as indicated in FIG. 17.

As in the case of the second embodiment of the ratchet wrench of the invention previously described, a depression of the cap 634 to effect only a partial displacement of the shaft 610 will still be effective to allow the tool locking ball 670 to recede inwardly into the shaft 610 to permit separation of the tang-carried tool from the stud end of the core. In this partially axially displaced configuration of the shaft 610, the core 530 will remain locked in the drive ring 520.

In order to enhance the operation of the drive reversing structures of the wrench, and as shown in FIGS. 17 and 19, there is provided a mechanism for establishing a frictional relationship between the core 530 and the circumscribing drive ring 520. As illustrated, the mechanism constitutes a bearing or ball 720 confined in a radially-extending bore 724 and urged by a spring 730 to abut and ride up against an inner face of the core circumscribing collar 520.

Figure 21:
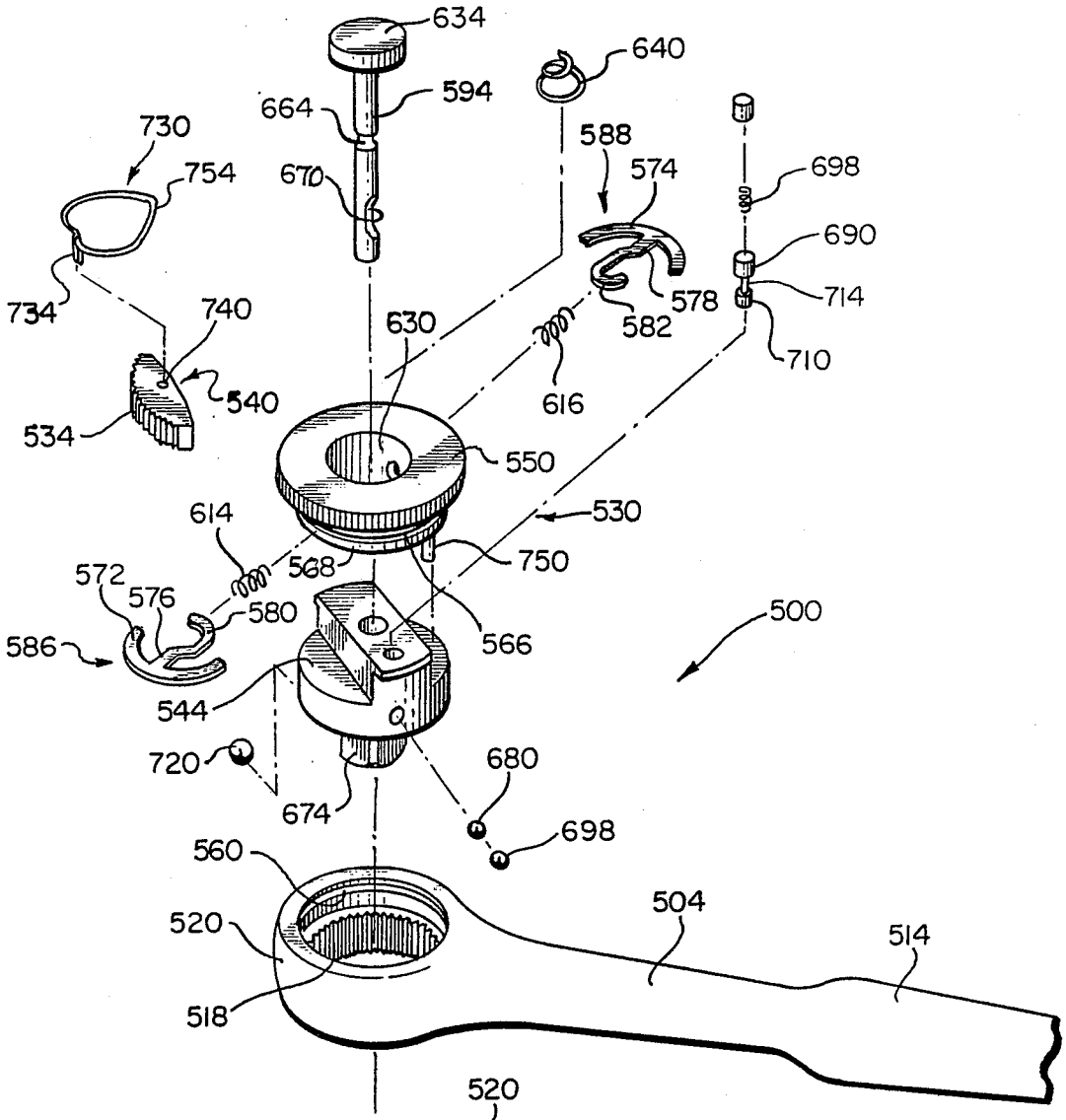
FIG 21 is an exploded view of the wrench embodiment of FIGS. 17 through 20.
Figure 22:
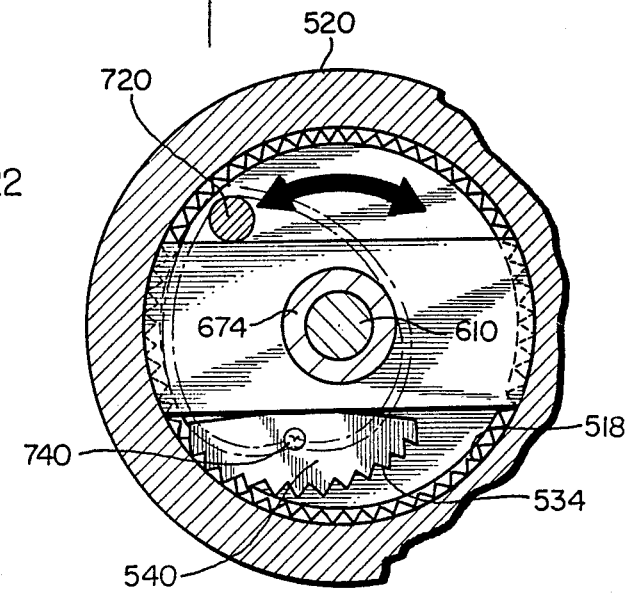
FIG. 22 is a cross-sectional view taken substantially on the lines 22—22 of FIG. 17 and showing the pawl reversing mechanism of the wrench of FIGS. 17 through 21.

The mechanism for reversing the pawl position to shift the ratcheting direction of the wrench is described with reference to FIGS. 21 and 22. There is provided a generally heart-shaped wire 730 the ends 734 of which extend generally downwardly and normally of a plane defined by the body of the wire and are received in a downwardly-extending cooperating bore 740 in the pawl 540. The drive direction reversing plate 550 is provided at its collar 568, as a downwardly-projecting extension therefrom, with a stub shaft or probe 750. The latter engages and bears against the heart-shaped wire interiorly thereof at its apex 754 as shown in FIG. 22. As the plate 550 is rotated, the probe depending therefrom brings stressing forces against the wire 730 and, in turn, the forces are transferred to effect a lateral shifting of the pawl 540 between first and second laterally-displaced operational modes. The mechanical arrangement described has the advantage of minimal friction between the moving and shifting components. Accordingly, the application of minimal frictional forces applied to the cam shifting plate 550 is adequate to effect a reversal of the driving mode of the wrench.

What is claimed is:

1. In a ratchet wrench having a tool head including a drive ring, a core rotatably journaled in said drive ring, selectively positionable pawl means for coupling said drive ring to said core to establish reversible driving modes for said wrench, a tool-element-engaging shank extending downwardly from said core, said drive ring and said core being formed with opposed and intercommunicating annular grooves defining a channel bridging and bounded by said ring and said core, and retainer means for detachably securing said core in said drive ring, said retainer means including interlock means for interlocking said drive ring and said core, said interlock means including band means received within said channel for mechanically intercoupling said ring and said core to prevent relative axial displacement therebetween and inadvertent removal of said core from said drive ring, the improvement comprising control means bearing on said band means retained in said channel and manually operable for selectively permitting said band means to assume, selectively, a first position in which said band means invades a single one only of opposed said annular grooves in said ring and said core, thereby to effect mechanical decoupling between said ring and said core and to permit ready axial displacement of said core with respect to said drive ring and to allow physical withdrawal of said core from said drive ring, and a second position in which said band means bridges said channel and projects into to invade each of opposed said annular grooves for establishing a mechanical interlock between and for mechanically interconnecting said drive ring and said core to prevent relative axial displacement therebetween.

2. The improvement as set forth in claim 1 wherein said control means is operable in a first functional mode thereof to position said band means to lie in a single one only of said annular grooves without entry into an opposed communicating other of said annular grooves, thereby to define a mechanical configuration in which said drive ring and said core are in an uncoupled relationship mode.

3. The improvement as set forth in claim 1 wherein said band means comprise arcuate plates, and wherein said control means is operable to position said band means simultaneously to invade each opposed communicating said grooves in said drive ring and in said core for establishing an interlocking engagement between said drive ring and said core for preventing relative axial displacement therebetween and to lock said core within said drive ring.

4. The improvement as set forth in claim 1 wherein said control means comprises pin means, guide means orienting said pin means to abut said band means, and means directing said pin means to abut said band means, and means directing said pin means to abut and to distort said band means and to urge said band means simultaneously to invade each opposed communicating said grooves in said drive ring and in said core for establishing an interlocking engagement between said drive ring and said core for preventing relative axial displacement therebetween and to lock said core within said drive ring.

5. The improvement as set forth in claim 1 wherein said control means comprises pin means, guide means orienting said pin means to abut against and bear upon said band means, and means urging said pin means stressingly against to distort said band means to cause said band means simultaneously to invade both opposed said communicating annular grooves in said drive ring and in said core for establishing an interlocking engagement between said drive ring and said core to prevent relative axial displacement therebetween and to prevent withdrawal of said core from said drive ring.

6. The improvement as set forth in claim 5 and further comprising spring means for applying distorting forces to said band means, and manually manipulable plug means for application of digital pressure thereagainst to overcome biasing forces of said spring means and for relieving band distorting pressure at said pin means, thereby to neutralize and overcome distortion forces applied to said band means by said spring means and to permit said band means to assume a normal rest configuration and resiliently to expand to occupy a single groove only of said communicating annular grooves, thereby mechanically to decouple said drive ring from said core to permit relative axial displacement therebetween and to allow ready removal of said core from said drive ring.

7. The improvement as set forth in claim 6 wherein said wrench is formed in a handle zone thereof adjacent said drive ring with an open ended bore, said plug means extending into said bore for telescoping reciprocal movement therewithin, said spring means being confined in said bore between a closed end thereof and an inwardly directed end of said plug means, and said spring means being operative resiliently to urge said plug means outwardly of said bore, to bear upon and to cam said pin means toward said core, and wherein said plug means is formed with a cavity opening laterally and in communication with a passage extending through said drive ring and terminating at said channel, said passage constituting a guide for said pin means moving therewithin, and said cavity having a boundary camming wall means abutting said pin means for urging said pin means toward said band means for displacing said band means from said annular groove in said driving ring, and into said annular groove in said core to establish said band means as a mechanical interlock for securing said core within said driving ring.

8. The improvement as set forth in claim 1 in which said core comprises a unitary assembly and wherein said core defines an assembled configuration upon release from said drive ring of said wrench.

9. The improvement as set forth in claim 1 and further comprising a control plate in said tool head, and linking means coupled to said control plate and to said pawl means and responsive to displacement of said control plate for shifting said pawl selectively between said driving modes, said linking means comprising resilient wire means extending between and coupling said control plate to said pawl means, displacement of said control plate being operative through said wire means to shift said pawl means into mating engagement with opposed cooperating teeth of said drive ring for establishing a selective given driving mode for said wrench.

10. The structure as set forth in claim 9 wherein said resilient wire means includes an arcuately curved body portion and integrally formed parallely disposed probe-like ends projecting in opposite directions and generally normally of a plane defined by said body portion of said wire means, said body portion of said wire means being disposed in a plane generally paralleling a principal plane of said control plate and being confined in a horizontal channel bounded by an underface of said control plate and a top surface of pawl means, and wherein said control plate is formed with a socket extending upwardly from a lower face thereof and normally of a plane of rotation of said control plate, and said pawl means is formed with a bore extending normally thereof and downwardly from an upper face thereof, said socket in said control plate and said bore in said pawl means receiving therewithin respective probe-like said ends of said resilient wire means for manipulatively coupling said control plate to said pawl means for shifting said pawl means upon rotational displacement of said control plate.

11. The structure as set forth in claim 9 and further comprising post means projecting downwardly from said control plate at an under surface thereof, and wherein said pawl means is formed with a bore extending downwardly therein normally of a plane of sliding travel of said pawl means in said core, said resilient wire means defining a planar, generally heart-shaped body and being formed with an apex-like mid-zone thereof for embracing said most means, and said wire means being formed at free ends thereof displaced from said mid-zone with integrally-formed probe-like projections extending normally of said body of said wire means for seating in said bore of said pawl means, arcuate rotation of the post-carrying said control plate imposing laterally-directed distortional forces on said resilient wire means to apply sliding force against said pawl means to shift said pawl means between selective opposed driving modes.

12. The structure as set forth in claim 11 wherein said wire means is formed with a loop at said mid-zone thereof for embracing said post means.

13. The improvement as set forth in claim 1 wherein said band means comprise an arcuate spring band, and wherein said control means comprises band-positioning means extending laterally of and interiorally of said spring band, said positioning means being selectively shiftable for stressing against to urge an arcuate section of said spring band radially outwardly of said annular groove in said core, thereby to bridge said channel and to invade said annular groove in said drive ring for establishing interlocking mechanical engagement between said drive ring and said core, elongated shaft means within said core and having a principal bounding surface, said shaft means projecting vertically through said spring band and normally of a horizontal plane defined thereby, said band-positioning means including rod means interposed between said shaft means and said spring band for displacing said spring band radially outwardly in said channel bridging said drive ring and said core, said shaft means being formed with socket means extending radially inwardly of a circumscribing principal bounding surface thereof presented to said band-positioning means, said socket means being adapted for receiving a radially inwardly directed end component of said band positioning-means therewithin, means for shifting said shaft means axially to bring said socket means into juxtaposed orientation with and to receive said end component of said band-positioning means therewithin and to permit said spring band to contract radially, to retract from said drive ring and to seat in said core, for effecting mechanical decoupling of said core from said drive ring of said wrench.

14. The improvement as set forth in claim 13 wherein said spring band constitutes means resiliently opposing radial expansion, and wherein in the absence of band-distorting forces applied thereto, said spring band assumes a position withdrawn from an annular groove in said ring and seats within an annular groove in said core for effecting disengagement of said spring band from said drive ring and for decoupling said core from said drive ring.

15. The structure as set forth in claim 14 wherein upon invasive entry of said band-positioning means into said socket means in said shaft means, said spring band undergoes radial contraction to effect a physical disengagement from said drive ring, said disengagement decoupling said drive ring from said core for permitting withdrawal of said core axially from said drive ring.

16. The improvement as set forth in claim 13 and further comprising spring means for resiliently supporting said shaft means and said socket means formed therein axially upwardly with respect to said spring band to retain said socket means in misalignment with said band positioning means to prevent entry of said end portion of said control means into said socket means and to preclude withdrawal of said spring band from said ring, thereby maintaining said drive ring and said core fixed in a mechanically intercoupled configuration.

17. The structure as set forth in claim 13 wherein said band-positioning means comprise a horizontally disposed pin, and a ball axially aligned with said pin, said pin and said ball being confined in a horizontally disposed bore in said core of said wrench, said pin having a radially outwardly directed end contacting said spring band and an opposite end abutting said ball, a zone of said ball opposite to said pin being in stressing contact with said shaft means for bearing thereagainst and for riding therealong as said shaft means is displaced axially within said tool head.

18. The structure as set forth in claim 1 and further comprising a driving direction control assembly including an annular, finger-actuable, arcuately-shiftable, drive-reversing control plate surmounting said drive ring, resilient wire means linking said control plate with said pawl means for shiftingly positioning said pawl means within said core to selectable driving modes of said wrench, said control plate having a tubular, pipe-like neck of a reduced diameter integrally formed therewith and depending therefrom, said neck projecting downwardly into and being sleeved within a cooperating, coaxially-extending chamber formed in said core interiorally of said drive ring, said control plate being formed with a recess opening upwardly of said plate and communicating at a base thereof with said neck interiorly thereof, an axially shiftable shaft slidably disposed within said neck and projecting downwardly therefrom, a disk-like cap surmounting said shaft and disposed for telescoping vertical displacement within said recess in said control plate, spring means within said recess in said control plate and interposed between an underface of said cap and a floor of said recess for resiliently biasing said cap and said shaft upwardly within said core.

19. The structure as set forth in claim 18 and further comprising interlock means for preventing inadvertent withdrawal of said tubular neck and said control plate carried thereby from said core in said wrench head, said interlock means comprising laterally shiftable lug means confined in a cavity within said core for interlockingly coupling said core with said neck of said control plate.

20. The structure as set forth in claim 19 wherein said lug means includes detent means directed radially within said core for seating within a cooperating transverse bore formed in said neck of said control plate for intercoupling engagement therewith, said interlock means further comprising spring means housed in said cavity in said core for urging said lug means radially inwardly within said tool head to seat said detent means in said neck of said control plate for establishing and to maintain an intercoupling mode of said core within said control plate for preventing inadvertent axial displacement of said control plate from said core.

21. The structure as set forth in claim 18 and further comprising a tool-element-retaining detent ball carried in said shank in a transverse bore formed in and opening laterally thereof, and wherein said shaft is formed with a radially directed depression in a bounding lateral wall thereof and displaced upwardly with reference to said detent ball, shifting of said shaft axially downwardly within said wrench head against biasing forces exerted by said spring means being effective to establish a juxtaposed spatial relationship between said ball in said shank and said depression in said shaft to permit invasive penetration of said ball into said depression for facilitating dislodgement of a detent-engaging tool element carried on said shank.

22. The structure as set forth in claim 19 and further comprising shoulder means carried by said lug means for abutment against said neck of said control plate at an outer circumscribing bounding wall thereof for restraining said lug means within said cavity of said core.

23. The structure as set forth in claim 22 and further comprising second spring means, and means confining said second spring means within said cavity in said core in axially stressing engagement with said lug means for biasing said lug means laterally toward, for effecting locking engagement of said detent means thereof within said neck of said control plate.

24. The structure as set forth in claim 13 and further comprising a pivotal control plate in said core of said tool head, a cap surmounting said shaft means and disposed in a cooperating, floored, upwardly-opening recess formed in said control plate for vertical displacement of said cap therewithin, spring means in said recess and interposed between a bounding floor of said recess and a facing under surface of said cap, said spring means being operable for biasing said cap and said shaft means depending therefrom to an upwardly-displaced operational mode in said wrench head, and for supporting said shaft means with said socket means formed therein in an out of juxtaposed orientational registry with said end component of said band-positioning means, thereby to obviate radial contraction of said spring band means and withdrawal of said band means from interengaging mechanical coupling with said drive ring, and to prevent disassembly decoupling of said core from said drive ring.

25. The structure as set forth in claim 24 wherein said spring means is responsive to pressure applied thereagainst through said cap and axially along said shaft means to prevent downward axial displacement of said shaft means to a position in which said socket means in said shaft means is in alignment with said end component of said band-positioning means to permit entry of said end component into said socket means and concurrently to permit radial withdrawal of said band means from engagement with said drive ring of said wrench and to allow physical separation of said core from said drive ring.

26. The structure as set forth in claim 25 and further comprising annular shoulder means enlarged radially with respect to said shaft means and encircling said shaft means at a juncture of a joinder of said shaft means to said cap, clip means in lateral abutment with and embracing said shaft means in a zone thereof invading said recess in said control plate, and clip means constituting stop means for interfering with and for resisting passage of said shoulder means therethrough, said clip means functioning in cooperative conjuncture with said shoulder means to define a first limit of axial advance of said shaft means downwardly through said wrench head.

27. The structure as set forth in claim 26 wherein said shoulder means on said shaft means includes annular claiming means for engaging said clip means at said first limit of axial advance of said shaft means and for distending said clip means to permit a second increment of axial advance of said shaft means downwardly into said wrench head, said second increment of advance being effective to bring said socket means in said shaft into opposed lateral alignment with said end component of said band-positioning means, to permit entry of said end component into said socket means, and to allow concurrent radial contraction of said spring band means, thereby mechanically decoupling said core from said drive ring and enabling withdrawal of said core from said wrench head.

28. The structure as set forth in claim 1 wherein said tool-element-engaging shank carries a laterally-shiftable detent ball, shaft means, said shaft means being formed with a depression opening laterally thereof, and wherein, upon displacing said shaft means downwardly to a first level of travel of advance, said depression is brought into juxtaposed relation with said detent ball to permit entry of said ball radially therewithin, thereby facilitating ready removal of a tool engaged on said shank.

29. The improvement as set forth in claim 1 wherein said band means comprises a first, generally anchor-shaped interlocking plate including an arcuate base sector shiftably seated in said channel and an are joined to said base sector and extending radially inwardly thereof, said arm having a free end engaging said control means and responsive to displacement positioning of said control arm for selectively shifting of said base sector radially between said first said position in said channel for locking said core in said drive ring during use of said wrench, and said second position in said channel for decoupling said core from said drive ring for permitting withdrawl of said core from said tool head.

30. The improvement as set forth in claim 29 and further comprising a second generally anchor-shaped interlocking plate diametrically opposed to and bilaterally symmetrically oriented with respect to said first plate in said core for cooperative co-action with said first interlocking plate, said second plate being shiftable for selectively securing said core within and for freeing said core from engagement within said drive ring of said wrench head.

31. The structure as set forth in claim 30 wherein each said arm of each said locking plate is looped at said radially inwardly directed free end thereof to embrace and to engage said control means on a lateral surface thereof remote from respective each said arcuate sector, and further comprising spring means for biasing each said arcuate sector of each said plate radially outwardly for effecting mechanical intercoupling between said core and said drive ring.

32. The structure as set forth in claim 31 wherein said control means includes elongated shaft means extending axially in said core and having a principal bounding circumscribing surface, and wherein said shaft means is engaged by said arm looped thereabout, said shaft means being formed with a radially enlarged surmounting collar, said shaft means being displacable axially downwardly within said core to bring said collar into radially stressing abutment with each said arm of said locking plate to effect displacement of each said arm and said base sector of said interlocking plate radially inwardly from a first said position defining a locking mode of said core in said drive ring to a second said position defining a mode in which said sector is withdrawn into said core and said core is decoupled from said drive ring, facilitating separation of said core axially from within said drive ring.

33. The structure as set forth in claim 32 and further comprising first spring means biasing said shaft means axially upwardly to an upper travel limit of said shaft means in which said arm engages said bounding surface of said shaft means below said collar and in a zone having a diameter less than that of said collar, thereby to establish a mode in which each said base sector of said locking plate is displaced radially outwardly to invade said drive ring and to effect an intercoupling of said core with said drive ring.

34. The structure as set forth in claim 33 and further comprising second spring means extending radially in said core and biasing each said interlocking plate radially outwardly for intercoupling each said base sector with said drive ring.

35. The structure as set forth in claim 32 and further comprising detent means for lockingly retaining said shaft means secured at a downwardly-displaced, core-releasing disposition, said detent means comprising, in combination, detent receiving socket means formed in and extending radially inwardly of said bounding surface of said shaft means, a detent element confined in a laterally-extending passage formed in said core, said passage having an open end presented to said socket means in said shaft means, whereby upon displacing said shaft means downwardly said detent element opposes and is received within said socket means to bridge and to intercouple said core and said shaft means for restraining said shaft means against axial displacement within said core, enabling manual withdrawal of said core axially from said drive ring.

36. The structure as set forth in claim 35 and further comprising locking pin means and resilient means urging said locking pin means against said detent element and shifting said detent element laterally into and for lockingly holding said detent element in said socket means releasably to lock said shaft means in a core-freeing mode for permitting withdrawal of said core from said drive ring.

37. The structure as set forth in claim 35 and further comprising locking pin means and spring means urging said locking pin means against said detent element, said spring means being stressingly confined in a cavity formed in said core and bearing against an end of said locking pin means and displacing said locking pin means in said cavity in said core, said locking pin means impressing laterally-directed displacement forces against said detect element for urging said detent element to invade said socket means of said shaft means for coupling said core with said shaft means when said socket means is at a position opposite and laterally aligned with said detent element.

38. The structure as set forth in claim 37 wherein upon penetration of said detent element into said socket means, said spring means urges said locking pin means downwardly to establish a lower end portion of said locking pin means as a finger-accessible projection extending downwardly beyond said core, said locking pin means being responsive to digital pressure applied upwardly against said end portion thereof to relieve laterally-directed displacement forces acting on said detent element and to permit retraction of said detent element from said socket means, thereby to disengage and to release said shaft means and to allow said interlock plates and said arcuate base sectors thereof to move radially outwardly into said groove in said drive ring for intercoupling said core with said drive ring.

39. The structure as set forth in claim 1 and further comprising friction means and means supporting said friction means to extend between and to interengage said core and said drive ring for establishing frictional forces therebetween during rotation of said core coaxially with and interiorly of said drive ring.

40. The structure as set forth in claim 1 wherein said core is formed with a bore projecting generally radially into said core and opening outwardly at a circumscribing bounding arcuate wall thereof, an end wall within said bore and delineating an inward limit of said bore interiorly of said core, a ball seated in said bore for movement in said bore axially therealong, spring means captively interposed and confined between said end wall and said ball for urging said ball radially outwardly of said core and into abutment with a core-circumscribing said drive ring at an inner generally cylindrical surface of said drive ring.

41. The improvement as set forth in claim 1 and further comprising a pawl-shifting plate, and means supporting said plate in said core for arcuate displacement of said plate, resilient wire means for shifting said pawl in said core, said wire means including a generally arcuate horizontal body section bridging between said plate and said pawl, means coupling said wire means at respective opposed end zones of said body section thereof to said control plate and to said pawl for transmitting horizontally directed displacement forces against said pawl through limited arcuate rotation of said control plate to shift said pawl selectively between reversible driving modes of said wrench.

* * * * *